United States Patent [19]

Selby

[11] Patent Number: 4,492,817

[45] Date of Patent: Jan. 8, 1985

[54] WATERTIGHT BUSHING AND BOLT MOUNTING ASSEMBLY

[75] Inventor: Donald W. Selby, Brentwood, Tenn.

[73] Assignee: Square D Company, Palatine, Ill.

[21] Appl. No.: 353,785

[22] Filed: Mar. 1, 1982

[51] Int. Cl.[3] ..... H01B 17/30

[52] U.S. Cl. ..... 174/152 R; 277/12; 277/189; 411/369

[58] Field of Search ..... 174/11 BH, 12 BH, 14 BH, 174/15 BH, 16 BH, 18, 31 R, 142, 143, 152 R, 153 R, 163 R, 167; 277/1, 12, 166, 178, 189; 411/369, 542; 220/81 R

[56] References Cited

U.S. PATENT DOCUMENTS

| | | | |
|---|---|---|---|
| 2,230,194 | 1/1941 | Stevens | 174/167 |
| 2,284,530 | 5/1942 | Meyer | 174/167 X |
| 2,396,005 | 3/1946 | Gross et al. | 411/369 X |
| 2,590,803 | 3/1952 | Unger et al. | 411/369 X |

FOREIGN PATENT DOCUMENTS

| | | | |
|---|---|---|---|
| 1400898 | 5/1969 | Fed. Rep. of Germany | 411/542 |
| 1267154 | 6/1961 | France | 174/18 |
| 844381 | 8/1960 | United Kingdom | 174/15 BH |

*Primary Examiner*—Laramie E. Askin

*Attorney, Agent, or Firm*—Larry I. Golden; Richard T. Guttman; Mary R. Jankousky

[57] ABSTRACT

A watertight bushing and bolt mounting assembly includes a collar portion around the bushing with a first groove within which is received an upturned flange surrounding an opening in the wall member through which the bushing extends. A resilient first seal member around the flange is pressed against the wall member, the flange or the shoulder formed therebetween to create a watertight seal around the opening when the bushing is clamped to the wall member. A clamp plate secures the bushing to the wall member by means of a watertight bolt mounting assembly which includes a nut with an annular cavity receiving an upturned lip surrounding the bolt bore. A bolt seal member is located around the lip of the bolt bore and is pressed by the nut against the wall member, the lip or the bolt shoulder formed therebetween to create a watertight seal around the bolt bore.

12 Claims, 4 Drawing Figures

WATERTIGHT BUSHING AND BOLT MOUNTING ASSEMBLY

BACKGROUND OF THE INVENTION

This invention relates to watertight bushing and bolt mounting assemblies.

Insulator bushings are used to safely convey an electrical wire, cable or other electrical conductor or device through a metal enclosure wall containing electrical equipment. When such electrical equipment enclosures are located outdoors or otherwise in possibly wet or damp environments, it is of the utmost importance that the enclosure be sealed against moisture to prevent damage to the enclosed electrical equipment.

Accordingly, numerous devices have been designed for sealingly mounting electrical insulator bushings. In U.S. Pat. No. 2,597,596 issued to Reid, an insulator bushing is provided with an annular shoulder which bears against a gasket ring. The gasket ring rests in the annular groove surrounding the opening in the side wall of the container to provide the needed seal. The collar is pressed against the gasket by a clamp which is mounted to the wall by means of screws. The screws extend through the clamp and into, but not through, the wall.

In U.S. Pat. No. 2,179,356 of Skvortzoff, a gasket is pressed between a bushing shoulder and an upturned annular wall surrounding an opening in the enclosure wall by means of clamps. The clamps are secured by bolts especially welded to the enclosure wall.

A structure used for mounting a condenser bushing is shown in U.S. Pat. No. 3,055,968 of Spiece that is similar to the assembly of Reid 2,597,596, but in which the clamp is secured by bolts that extend into threaded metal grommets especially attached to the wall for that purpose.

Other similar structures are also shown in U.S. Pat. No. 2,300,195 of Bennett; U.S. Pat. No. 2,343,210 of Vienneau and U.S. Pat. No. 3,054,975 of Barr.

All of the assemblies shown in these patents suffer from one of these disadvantages. Some of these mounting assemblies require an enclosure wall of sufficient thickness to provide adequate support for a screw or the like. Others require provision of special grooves in the wall or special connectors, such as bolts or grommets, fixedly secured to the wall by means of welding.

SUMMARY OF THE INVENTION

Accordingly, the principal object of the present invention is the provision of a watertight bushing assembly which includes a thin wall construction and which does not require the welding of bolts, grommets or other special fixtures to the wall or the formation of special grooves around the bushing or bolt openings in the wall.

In keeping with this object, I provide a watertight bushing assembly comprising an elongate member passing through an opening in a wall member, a collar portion attached to and surrounding the elongate member which has a first circular groove for receipt of a flange surrounding the opening, a resilient first seal member for providing a seal around the flange and opening, and means for securing the insulator to the wall member with the resilient first seal member resiliently squeezed between the collar portion adjacent the groove, on the one hand, and the flange, wall member, or juncture of the flange and wall member, on the other hand.

A further object of my invention is the provision of a watertight bolt mounting assembly useful in clamping the collar portion to the wall member. In this assembly, I provide an elongate bolt adapted to pass through a bore in a wall member and a hole in a mating nut. The nut has a cavity surrounding the threaded hole therethrough for receipt of a lip surrounding the bore in the wall member and a lower surface adapted to press against a resilient first bolt seal surrounding the lip.

DESCRIPTION OF THE DRAWING

The foregoing objects and advantages will be described in greater detail and further features and advantages will be made apparent in the following detailed description of the preferred embodiment given with reference to the several views of the drawing, in which.

DETAILED DESCRIPTION

Figure 1:
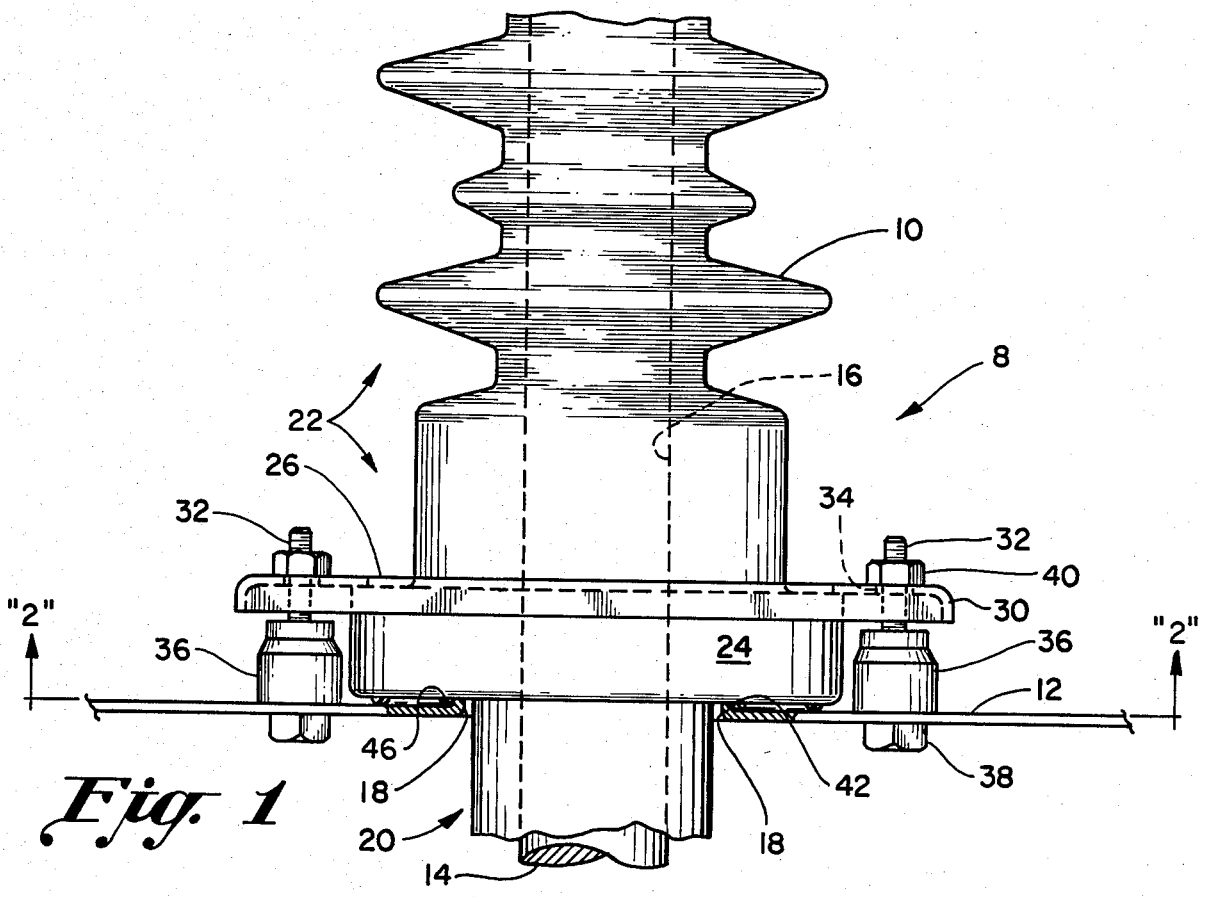
FIG. 1 is a side elevational view of a preferred form of my watertight bushing and bolt mounting assembly.

Referring now to the drawings, particularly FIG. 1, my watertight bushing and bolt mounting assembly 8 can be seen to comprise an electrical bushing 10 and a roof panel or other wall member 12 of an electrical enclosure or the like. An inner section 20 of bushing 10 extends through a circular opening 18 in wall member 12. The bushing has an elongate, circular cross-sectional shape and is made of rubber or other suitable electrical insulating material. The insulating material protectively surrounds an electrical conductor or other electrical device 14 within an elongate, axial passageway 16 extending through bushing 10. In this way, the electrical conductor 14 is given lateral support and protected against electrical contact with other conductive elements, particularly the metal edge of metal wall member 12 at opening 18.

Figure 2:
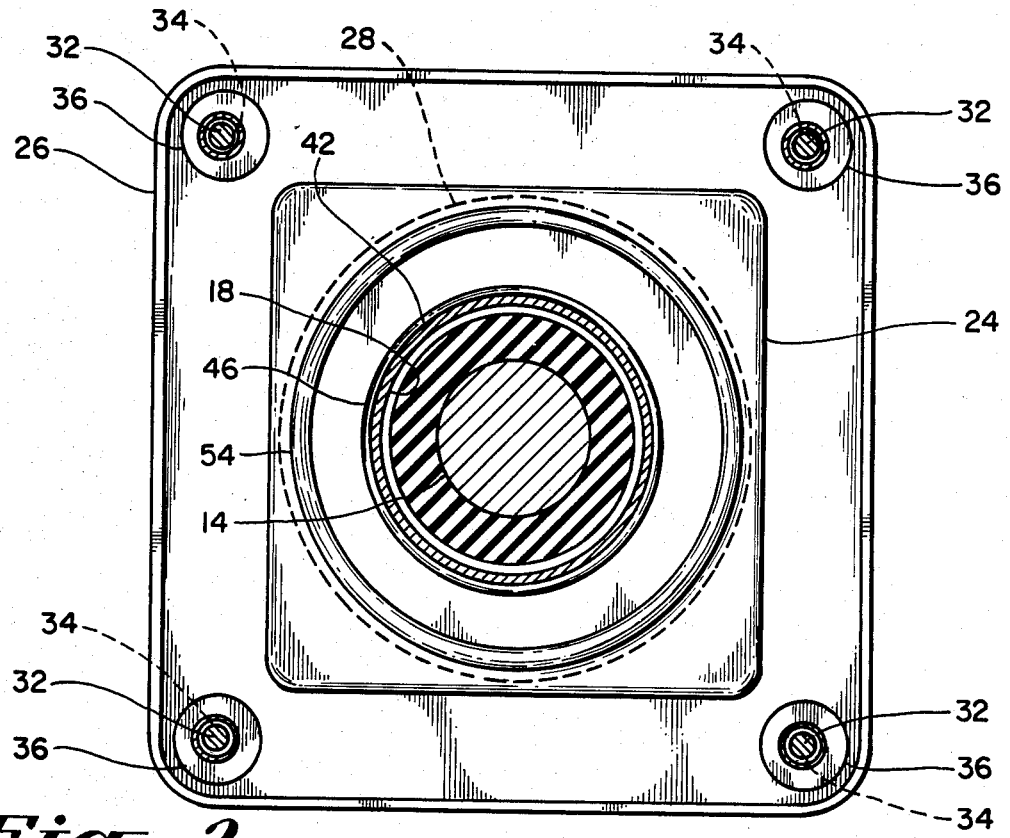
FIG. 2 is a sectional view of the bushing and bolt mounting assembly along lines 2—2 of FIG. 1.

An outer section 22 of bushing 10 includes a substantially cylindrical collar portion 24 which overlies the peripheral portion of wall member 12 around opening 18. Overlying collar portion 24, in turn, is a rectangular clamp plate 26, also seen in FIG. 2. The clamp plate 26 has a centrally located circular aperture 28 through which extends the inner section 20. The clamp plate 26 also has a downturned protective rim 30 for increasing its rigidity.

The plate 26 is mounted to wall member 12 by means of four identical bolts 32 (only two shown) respectively extending through four bolt orifices 34 located in the four corners of clamp plate 26. Each of the bolts 32 is tightly secured to wall member 12 by means of a nut 36. Each bolt 32 has a bolt head 38 located at the inner surface of wall member 12, and the nut 36 is tightly screwed down on its associated bolt 32 against the outer surface of wall member 12. A length of the threaded shank of bolt 32 extends outwardly from nut 36 and through its associated bolt orifice 34 in clamp plate 26. A second nut 40 is screwed down tightly on this threaded shank against the outer surface of clamp plate 26. When all four second nuts 40 are tightened down on their respective bolts 32, the clamp plate tightly presses the collar portion 24 against the upper surface of wall member 12.

Figure 3:
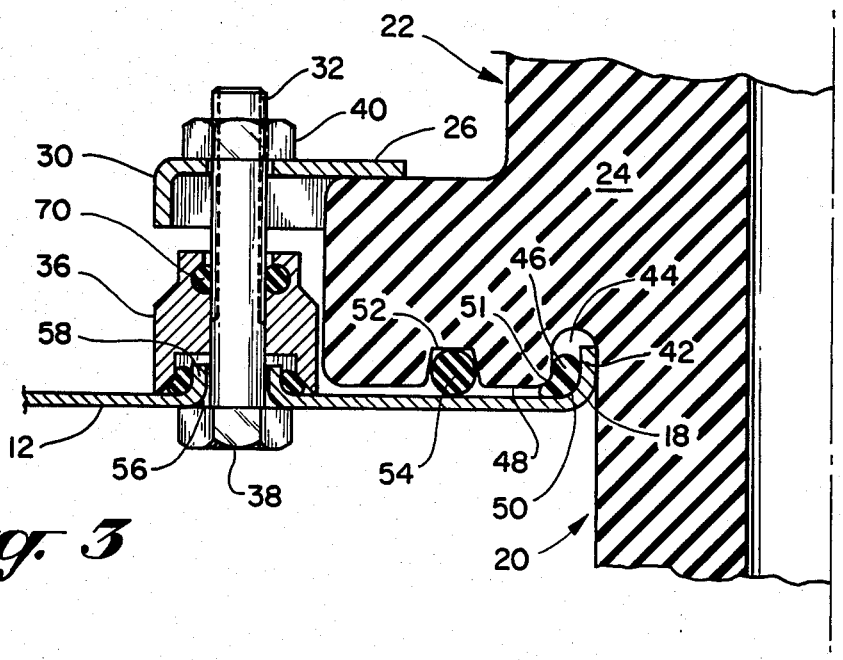
FIG. 3 is an enlarged side view, partially in section, of a portion of my watertight bushing assembly.

Referring now to FIG. 3, in keeping with another important aspect of my invention, wall member 12 has an upturned flange 42 surrounding the periphery of opening 18, and collar portion 24 has a circular first groove 44 in its inner surface within which is received flange 42. This flange functions to increase the rigidity of wall member 12 surrounding opening 18. More importantly, it functions as a bearing surface for a first resilient seal member 46, such as an O-ring, and as a guide for axially aligning the bushing 10 and the opening 18. The resilient first seal member 46 is placed around the outer surface of flange 42.

The elongate body portion 20 of bushing 10 is inserted through opening 18 and the first groove 44 is fitted over flange 42. The groove is defined by a first surface coextensive with the body portion of the bushing, a spaced apart second surface and a bridging portion between the first surface and the second surface. Thereafter, when the collar portion is clamped to wall member 12, the first seal member is resiliently squeezed between the second surface of the first groove 44 and flange 42, or, as shown in FIG. 3, between the corner connecting the second surface and the collar portion surface parallel to the wall member and the shoulder 50 between the flange 42 and wall member 12. The collar portion is provided with a generally planar surface portion 48 overlying and parallel to a portion of wall member 12 around opening 18. A corner 51 of collar portion 24 engages and squeezes the resilient first seal member 46 against flange 42. This first seal member 46 prevents the entry of moisture into opening 18.

In addition, as seen in FIG. 3, collar portion 24 is also provided with a circular second groove 52 spaced radially from first groove 44. Second groove 52 is adapted for receipt of a portion of a larger second seal member 54 which is also resiliently pressed or squeezed against the upper surface of wall member 12 around opening 18 to provide additional sealing.

Figure 4:
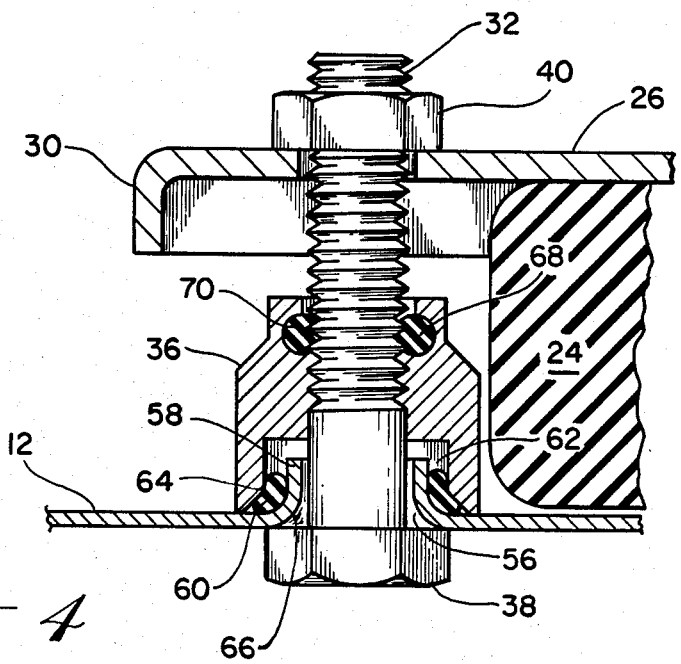
FIG. 4 is an enlarged side elevational view, partially in section, of my watertight bolt mounting assembly.

Referring now to FIG. 4, the aspect of my invention relating to the mounting of bolt 32 to wall member 12 in a watertight manner will be described. As with the opening 18, each of bolts 32 extends through a bolt bore 56 surrounded by an upturned lip 58. Surrounding the lip 58 is a resilient, first bolt seal member 60. As with collar portion 24, nut 36 is provided with an annular cavity 62 within which is received the lip 58 and a portion of first bolt seal member 60. The bottom surface 64 of nut 36 adjacent lip 58 presses the first bolt seal member 60 resiliently against wall member 12 or lip 58. A bottom surface 64 which is beveled with respect to the lip 58 and wall member 12 as shown in FIG. 4, will press the first bolt seal member 60 against both wall member 12 and lip 58 at the bolt shoulder 66 formed at the juncture therebetween. The first bolt seal member 60 prevents the entry of water through the bolt bore 56. Nut 36 is also provided with a second cavity groove 68 around its bore within which is seated a second bolt seal member 70 to provide additional sealing.

In making my bushing assembly, I proceed as follows. First, I cut an opening in the wall member having a diameter slightly less than that of the desired diameter for opening 18 by an amount approximately equal to the desired height of flange 42. I then, by means of any suitable extrusion tool, form the flange 42 by bending the peripheral edge of malleable wall member 12 upwardly around the periphery of the opening until the selected diameter for opening 18 is achieved. I then make each of bolt bores 56 and their associated lips 58 in a similar fashion. First bolt seal members 60 are then placed around each of the bolt lips 58. The bolts 32 are inserted through their associated bolt bores 56. Then, the nuts 36 are tightened down to secure the bolts to wall member 12 and resiliently press the first bolt seal members 60 around the bolt bores 56.

The first and second seal members 54 and 46 are then placed within their associated grooves 52 and 44, respectively, and the inner section 20 of bushing 10 is inserted into opening 18 with first seal member 46 pressed against shoulder 50. Alternately, the first seal member 46 can first be placed around the flange 42 and then the collar portion 24 and first groove 44 lowered down onto the first seal member 46 and flange 42.

After the bushing 10 is seated properly in opening 18, the clamp plate 26, if not already in place, is lowered down onto the top of collar portion 24 with bolts 32 extending through the associated bolt orifices 34. The second nuts 40 are then screwed down tightly onto the top surface of clamp plate 26 to press the collar portion 24 tightly against the resilient first and second seal members 46 and 54.

While a particular embodiment has been disclosed herein, it should be appreciated that many variations may be made without departing from the scope of my invention, as defined in the appended claims. For instance, although it is preferred to have the lip or flange completely surround the opening, upturned tabs spaced from one another around the opening could also be employed so long as a seal surrounding the opening is made against the wall member.

I claim:

1. A watertight bushing assembly comprising:

a wall member having an opening;

an upturned flange peripherally surrounding said opening and extending generally perpendicular to said wall member;

a bushing extending through said opening, said bushing including an elongate body portion and a collar portion surrounding said body portion and overlying said wall member around said opening, said collar portion having a circular first groove receiving said flange, said first groove being defined by a first surface coextensive with said body portion, a spaced apart second surface and a bridging portion extending between said first surface and said second surface;

a resilient first seal member received in said first groove intermediate said flange and said second surface, said flange abutting against said first surface; and means securing the bushing to the wall member with the resilient first seal member resiliently squeezed within the first groove between the second surface and the flange.

2. A watertight bushing assembly as claimed in claim 1 in which said resilient first seal member comprises an O-ring.

3. A watertight bushing assembly as claimed in claim 1 in which said collar portion has a second groove radially spaced outward from said first groove; and a second seal member received in said second groove and pressed against the wall member.

4. A watertight bushing assembly as claimed in claim 1 in which said securing means includes means clamping the collar portion to the wall member.

5. A watertight bushing assembly as claimed in claim 4 in which said wall member includes a plurality of bores, each having a surrounding lip, and said clamping means includes:

a watertight bolt assembly comprising a plurality of bolts passing through the respective bores in the wall member, and a plurality of nuts each having a hole therethrough receiving a respective bolt and having a cavity surrounding said hole and receiving a respective lip; and a plurality of resilient bolt seal members received in said respective cavities adjacent said lips and squeezed between said lips and said nuts.

6. A watertight bushing assembly as claimed in claim 1 in which the collar portion of the bushing includes a generally planar surface in overlying and parallel relationship to a portion of said wall member; and a corner extending between said second surface and said planar surface, said corner and planar surface squeezing the first seal member against the wall member and flange positioning said first seal member within said groove and intermediate said planar surface and said wall member adjacent said corner.

7. A watertight bolt mounting assembly comprising:

a wall member including a plurality of bores, each having a surrounding lip;

a plurality of bolts substantially perpendicular to said wall member and passing through the respective bores in the wall member;

a plurality of resilient bolt seal members surrounding said lips and bores; and a plurality of nuts each having a hole therethrough receiving a respective bolt, each nut also having a cavity surrounding the hole receiving a respective lip, each nut being tightened onto its respective bolt to squeeze the respective bolt seal member between the nut and the respective lip.

8. The watertight bolt mounting assembly as claimed in claim 7 in which:

there are mating threads on the nuts and the bolts, and each nut is screwed tightly to a respective bolt.

9. The watertight bolt mounting assembly as claimed in claim 7 in which said each resilient bolt seal member is also squeezed between a nut and the wall member adjacent a lip.

10. The watertight bolt mounting assembly as claimed in claim 7 in which said resilient bolt seal members each comprises an O-ring.

11. The watertight bolt mounting assembly as claimed in claim 7 in which each resilient bolt seal member is squeezed by a surface of the respective nut which is beveled with respect to the respective lip and wall member.

12. The watertight bolt mounting assembly as claimed in claim 7 in which each nut includes a cavity surrounding the hole for receipt of an O-ring seal.

* * * * *